United States Patent [19]

Peter et al.

[11] Patent Number: 4,690,261

[45] Date of Patent: Sep. 1, 1987

[54] SHIP PROPULSION TRANSMISSION WITH AT LEAST ONE ENGAGEABLE FRICTION CLUTCH

[75] Inventors: Rudolf Peter; Ernst Jahnel; Hans-Peter Kunz, all of Augsburg, Fed. Rep. of Germany

[73] Assignee: Zahnraderfabrik Renk AG, Fed. Rep. of Germany

[21] Appl. No.: 831,563

[22] Filed: Feb. 21, 1986

[30] Foreign Application Priority Data

Feb. 21, 1985 [DE] Fed. Rep. of Germany ..... 3505987

[51] Int. Cl.[4] ..... F16D 25/11

[52] U.S. Cl. ..... 192/87.13; 192/109 F

[58] Field of Search ..... 192/109 F, 52, 87.19, 192/87.18, 87.15, 87.14, 87.13, 87.12, 87.11, 87.1, 5.57, 0.098; 74/661, 665 B, 665 Q

[56] References Cited

U.S. PATENT DOCUMENTS

| | | | |
|---|---|---|---|
| 3,529,705 | 9/1970 | Cudnohufsky | 192/87.18 |
| 3,653,476 | 4/1972 | Allen et al. | 192/87.19 X |
| 3,809,201 | 5/1974 | Miyanishi et al. | 192/109 F X |
| 3,823,801 | 7/1974 | Arnold | 192/87.19 |
| 3,991,865 | 11/1976 | Komatsu | 192/109 F |
| 4,086,994 | 5/1978 | Hirosawa et al. | 192/109 F |
| 4,465,168 | 8/1984 | Sato | 192/87.19 X |
| 4,515,255 | 5/1985 | Haley et al. | 192/3.57 |

FOREIGN PATENT DOCUMENTS

| | | |
|---|---|---|
| 2501391 | 1/1977 | Fed. Rep. of Germany . |
| 2652385 | 5/1978 | Fed. Rep. of Germany . |

OTHER PUBLICATIONS

DE-Z. "Maschinenmarkt", 1966, Nr. 27, S. 621.

De Buch, Schaltplane der Olydraulik, H. Zoebl, Krausskopf-Verlag, 4. Aufl. 1973, S. 58, 59.

*Primary Examiner*—George H. Krizmanich

*Attorney, Agent, or Firm*—Larson and Taylor

[57] ABSTRACT

A ships propulsion transmission system with at least one engageable friction clutch (10, 18) in the drive line between the ship engine (28, 30) and propeller (26), characterized by a device (20, 70, 6, 14, 76, 108) for setting the operating pressure of the friction clutch (10, 18) during the starting up process time-dependent and sequentially so that the operating pressure during the starting up process, is at least once, at a peak level and then subsequently is at a lower intermediate level, before it then is held at the final level.

5 Claims, 13 Drawing Figures

SHIP PROPULSION TRANSMISSION WITH AT LEAST ONE ENGAGEABLE FRICTION CLUTCH

FIELD OF THE INVENTION

The invention relates to a ship motor with at least one gear engageable friction clutch in the drive line between the ship motor and the propeller.

SUMMARY OF THE INVENTION

In the invention, the object of starting up the ship propeller from a standstill is attained even through an especially high trip torque is required to start it. In this process, an overload of the friction clutch, which occurs when the friction clutch is being thrown into gear by too great a gear shifting stress, is to be avoided. Too sharp an acceleration of the ship engine speed during this starting up process is also to be prevented.

This object is attained according to the invention by a device which sets the operating pressure of the friction clutch during the starting up process at different values, time-dependent and sequentially. Thus, the pressure during the starting up process is first at least once at a peak level, and then subsequently is at a lower intermediate level, before it is then held at the final level.

Other features of the invention are disclosed hereinbelow.

BRIEF DESCRIPTION OF THE DRAWINGS

Several embodiments of the invention are described hereinafter and are shown in the drawings wherein.

DETAILED DESCRIPTION OF THE PREFERRED EMBODIMENTS

Figure 1:
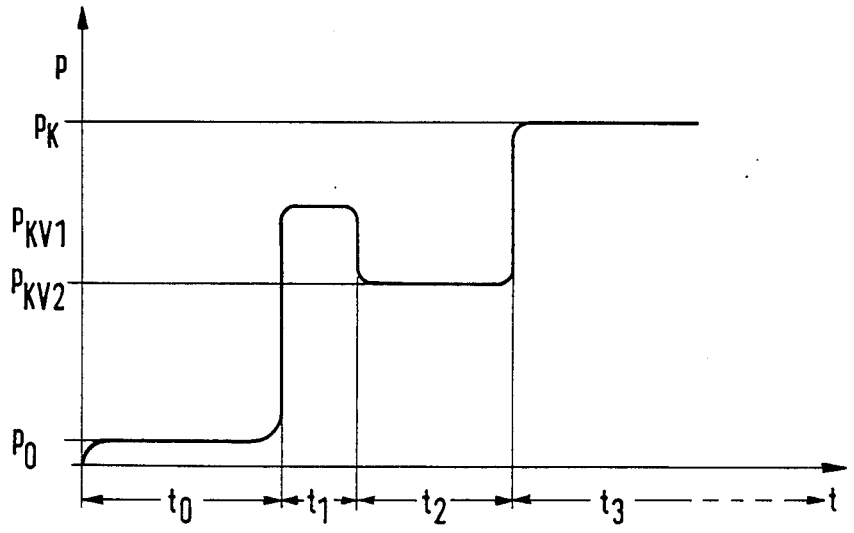
FIG. 1 is a graph of the various operating pressures of the friction clutch or clutches as a function of time during the process of actuating the clutches, with the use of a control circuit according to the present invention.

In FIG. 1, the time is shown on the abscissa and the operating pressure $p_K$ on the ordinate. The operating pressure is produced hydraulically by an essentially incompressible pressure medium, preferably oil. The curve depicted begins at the time point zero, where the operating pressure on the clutches is zero. Upon connection, the pressure medium fills the cylindrical chamber of the friction clutches during a filling time $t_0$. The pressure $P_0$ required for this does not suffice to close the clutches, so they convey a slight torque. This filling time is practically a dead time, which must certainly be taken into consideration. Then, the operating pressure of the pressure medium in the clutches rises to the adjusted intermediate level $P_{KV1}$ and is held at this peak during a first time phase $t_1$. This produces the desired trip torque, in order to bring the propeller from standstill into movement. Thus, the clutch disks of one or both of the friction clutches (depending on which are selected by the ships operator) are heated up, and engage each other with the high pressure corresponding to the peak pressure level. The ship engine is simultaneously speeded up. During this state the clutches do not overheat on account of too great friction, and thus the engine does not choke by dropping below a certain lowest speed. The operating pressure of the clutch or clutches is then lowered to an intermediate level $P_{KV2}$ following the first time phase $t_1$, and is held constant during a second phase $t_2$. The time phase $t_2$ is preferably considerably longer than time phase $t_1$. A third time phase $t_3$ follows second time phase $t_2$, and is unlimited in time and during which the operating pressure of the friction clutches is held to a final value $P_K$. The slip phase of the clutches is terminated in the third time phase $t_3$, at the latest. In a special configuration which is not shown in the drawings, for certain uses, often a peak level and then an intermediate level are combined, before the final level. Furthermore, it is possible to adjust the peak level or levels at the same level as the final level, but the peak levels preferably lie lower than the final level.

In FIGS. 2 to 13, identical parts are provided with the same references and are described only relative to one embodiment, insofar as the functions coincide.

Figure 2:
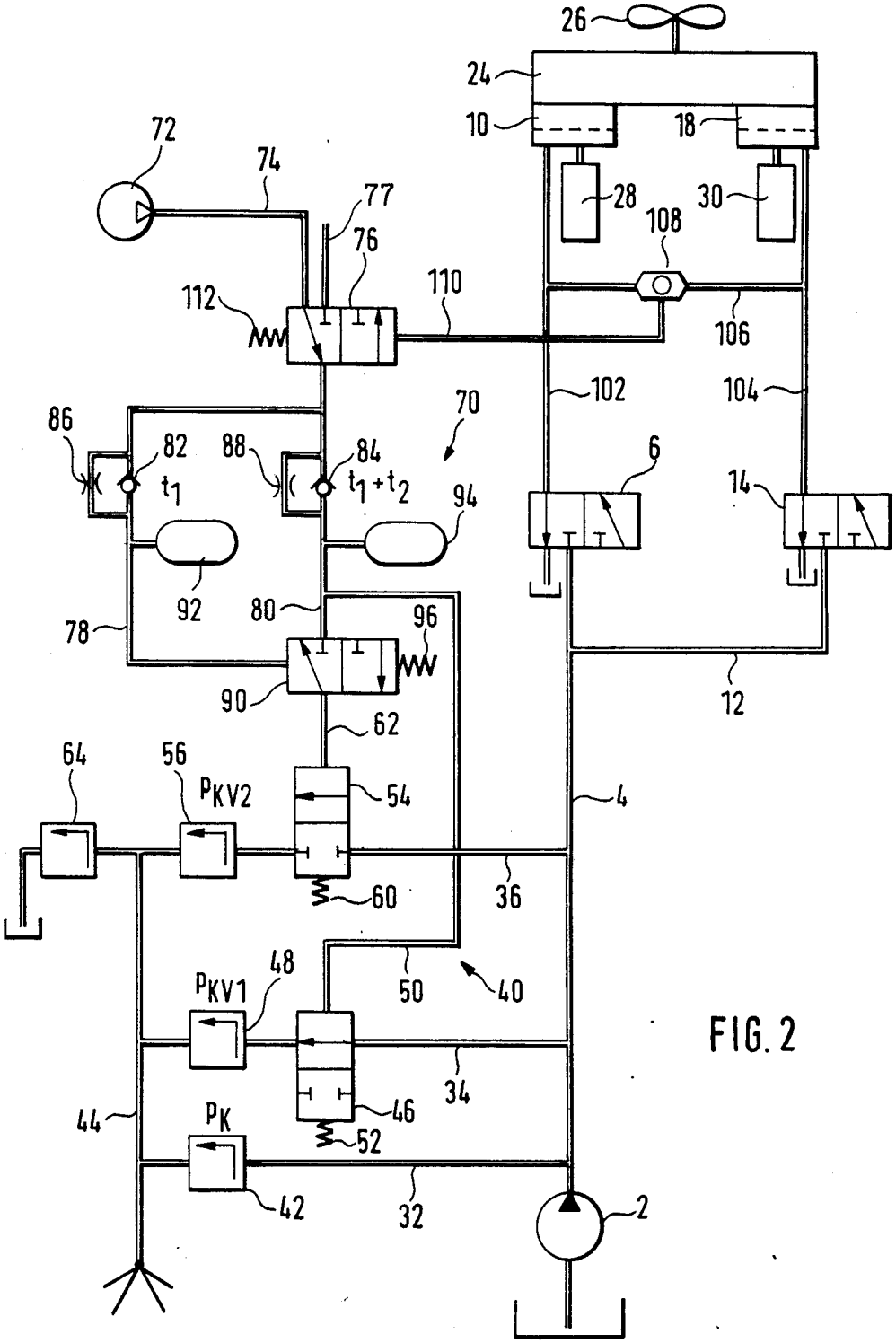
FIG. 2 is a schematic diagram of a control circuit according to the invention for friction clutches in the drive line between the engine and the propeller of a ship power transmission system, with the clutches open.

In FIG. 2, a pump 2 for conveyance of the pressure medium, preferably oil, through a load line 4, in which is found a pilot valve 6, is attached to the cylindrical space of a an engageable friction clutch 10 in the form of a disk clutch. A branch line 12 is connected to load line 4 between pump 2 and pilot valve 6. Branch line 12 carries a second pilot valve 14 and leads into the cylindrical space of a second an engageable friction clutch 18 in the form of a disk clutch. The secondary parts of friction clutches 10 and 18 drive a ship propeller 26 through a gearing 24. The primary parts of both friction clutches are each driven by a ship engine 28 or 30. As is known, the pilot valves 6 and 14 are operated manually by the ship's operator, depending on whether the operator wants to drive the propeller 26 with engine 28 or engine 30 or simultaneously with both engines 28 and 30.

Three control lines 32, 34 and 36 of a pressure maintenance valve arrangement 40 are connected from load line 4 in the direction of flow of pilot valves 6 and 14. The control line 32 has a pressure maintenance valve 42, which is set at the final pressure $P_K$. Control line 32 leads through a common main 44 into the lubricant oil system for the clutches 10 and 18 and the gearing 24. The branch line 34 likewise leads to common main 44. Branch line 34 includes a pilot valve 46 in the form of a two-way valve with two switch positions, and a pressure maintenance valve 48 which is set at the peak level $P_{KV1}$. Pilot valve 46 is held in the position shown in which it is open, by compressed air from a compressed air line 50 holding it against the force of a spring 52. The control line 36 likewise leads to common main 44 and includes a pilot valve 54 in the form of a two-way valve with two gear positions, and a pressure maintenance valve 56, which is set at the peak level $P_{KV2}$. Pilot valve 54 is held by a spring 60 in closed position as shown in FIG. 2 since a compressed air line 62 attached to pilot valve 54 is pressureless in this situation. Common main 44 includes a pressure safety valve 64.

Figure 3:
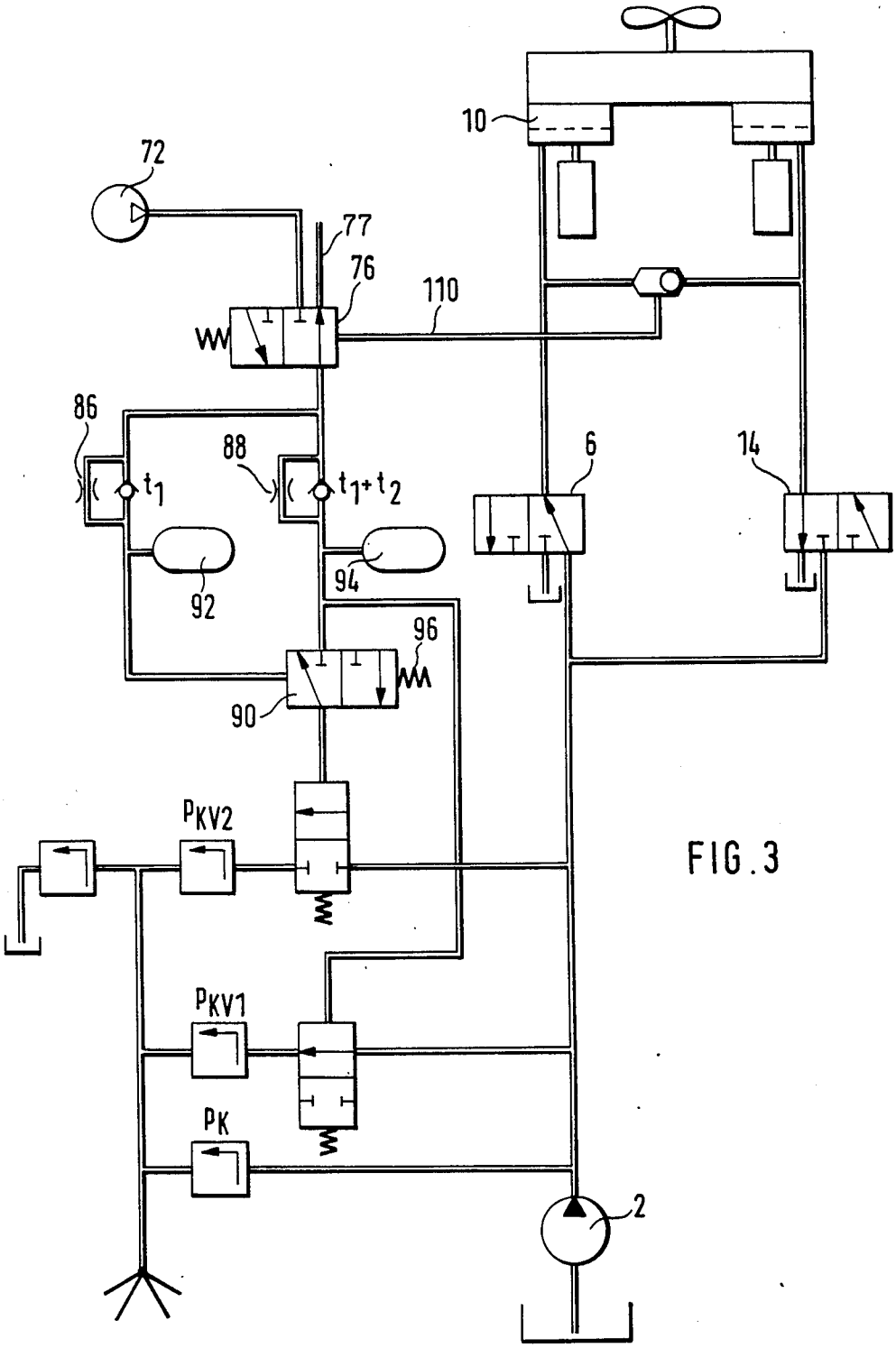
FIG. 3 is a schematic diagram of the control circuit of FIG. 2, during a first time phase during actuation of the friction clutches during which the operating pressure of the friction clutches is at a certain predetermined peak pressure level.

A flow medium timer circuit 70 is fed from a compressed air source 72. Air source 72 is connected through a compressed air line 74 and a pilot valve 76 contained therein, in the form of a 3-way-2-position valve, to two pneumatic control lines 78 and 80. Each of these control lines 78 and 80 has a check valve 82 or 84, each of which allows the compressed air coming from compressed air source 72 only to flow through, but not to flow back. An adjustable flow restrictor throttle 86 or 88 is connected parallel to each of the check valves 82 and 84. Control line 78 supplies the operating pressure for a pilot valve 90. Between the throttle-check valve unit 82, 86 and the pilot valve 90, control line 78 has a container 94 for air storage. Control line 80 likewise leads to valve 90 and has a container 94 for air storage between throttle-check valve unit 84, 88 and pilot valve 90. Pilot valve 90 is a 3-way-2-position valve. In the situation shown in FIG. 2, pilot valve 76 connects compressed air source 72 with control lines 78 and 80. Thus, both containers 92 and 94 are filled with compressed air, of which the pressure corresponds to the pressure of compressed air source 72. As a result of this pressure in control line 78, pilot valve 90 is held in closed position against the pressure of a spring 96, whereby control line 80 has no connection with compressed air line 62 of pilot valve 54. On the other hand, the pressure of container 94 of control line 80 is also conducted in compressed air line 50 to the pilot valve 46, so that, as aforementioned, this is opened against the pressure of spring 52 in the manner shown. A hydraulic pressure with the peak value $P_{KV1}$ is thus produced in load line 4. Friction clutches 10 and 18, however, are open, since according to the ship operator's selection pilot valves 6 and 14 are closed and thus the hydraulic pressure cannot reach the friction clutches. The line sections 102 and 104 between pilot valves 6 and 14 and the cylindrical spaces of friction clutches 10 and 18 are connected with each other by a circuit branch 106, in which is found a double check valve 108. In the situation shown in FIG. 2, no pressure medium from pump 2 is found in friction clutches 10 and 18 nor in double check valve 108, so that hydraulic control line 110 is also without pressure and pilot valve 76 is held by its spring 112 in this position shown in FIG. 2. FIG. 3 shows the situation during the time phase $t_1$, during which the operating pressure for the friction clutches has the peak value $P_{KV1}$. This is always the case when, as in FIG. 3, at least one of the two pilot valves 6 and/or 14 is switched to open, and thus the hydraulic pressure of pump 2 can build up in the selected clutch-cylinder space or spaces. The switching of one of the pilot valves 6 or 14 to open corresponds to the time point zero in the diagram of FIG. 1. In this example, valve 6 will be opened and value 14 left closed. Following time phase $t_0$, the peak pressure $P_{KV1}$ is established on clutch 10. Clutch 10 thereby switches at the end of time phase $t_0$, which is the beginning of the first time phase $t_1$. This pressure then moves the valve element in double check valve 108 to pressurize control line 110 which in turn switches pilot valve 76 into the position shown in FIG. 3. Henceforth, the pressure release of both air storage containers 92 and 94 begins through throttles 86 and 88 and pilot valve 76 to outlet line 77. This state, with the pak pressure $P_{KV1}$, lasts as long as the air pressure of air storage container 92 is sufficient to hold pilot valve 90 against the pressure of spring 96 in the position shown in FIG. 3.

Figure 4:
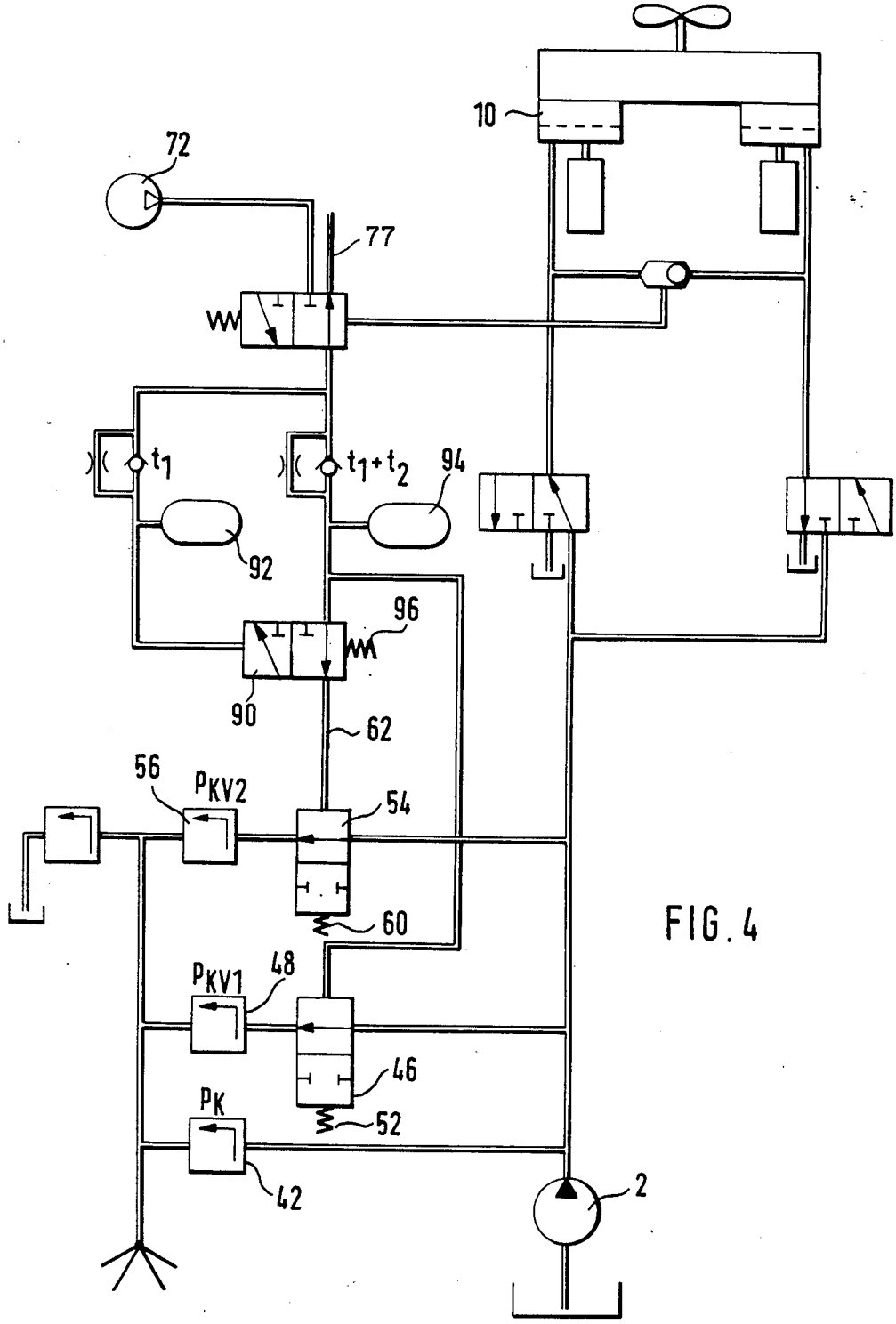
FIG. 4 is a schematic diagram of the control circuit of FIG. 2, during a second time phase, during which the operating pressure of the friction clutches is at an intermediate level lower than the peak level.

At the end of the first time phase $t_1$, the air pressure of air storage container 92 has dropped so low that the spring 96 switches pilot valve 90 into the position shown in FIG. 4. Thus, air storage container 94 is connected through pilot valve 90 with control line 62 of pilot valve 54 and its air pressure holds this pilot valve 54 in the position shown in FIG. 4, against the pressure of spring 60. The operating pressure $P_{KV2}$ of pressure maintenance valve 56 is thus established on friction clutch 10. This state remains so long as the air pressure present in pressure storage container 94 holds pilot valves 54 and 46 in the open position shown in FIG. 4. Thus only pressure maintenance valve 56 is open, while pressure maintenance valves 48 and 42, because they are set at a higher pressure than valve 56, are closed.

Figure 5:
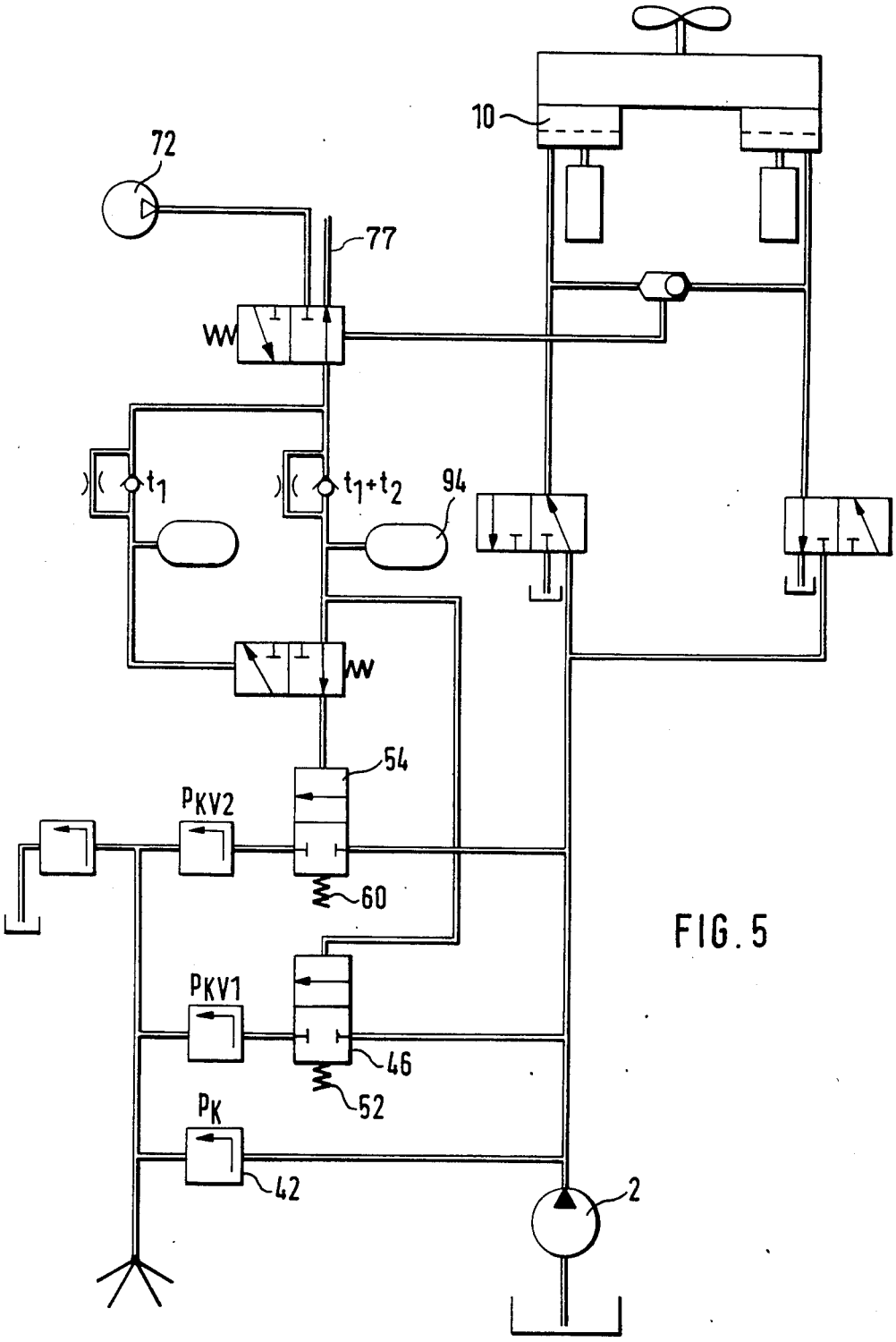
FIG. 5 is a schematic diagram of the control circuit of FIG. 2, during a third time phase, during which the operating pressure of the friction clutches is held at a final level.

At the end of time phase $t_2$, the air pressure of air storage container 94 has dropped so low that both pilot valves 54 and 46 are simultaneously switched by their springs 60 and 52 into their closed positions shown in FIG. 5. From this time on, friction clutch 10 exerts an operating pressure at the final level $P_K$ of pressure maintenance valve 42 opened at the end of time phase $t_2$.

The control circuit of FIGS. 6 to 9 according to the invention operates the same as the control circuit of FIGS. 2 to 5, corresponding to the diagram of FIG. 1. In the gear shift position of FIG. 6, the same operation is shown as in the gear shift position of FIG. 2; in the gear shift position of FIG. 7, the same operation is shown as in the gear shift position of FIG. 3; in the gear shift position of FIG. 8, the same operation is shown as in the gear shift position of FIG. 4; and in the gear shift position of FIG. 9, the same operation is shown as in the gear shift position of FIG. 5. The same parts also carry the same references and are not further described.

Control circuit of FIGS. 6 to 9 is different from the embodiment of FIGS. 2 to 5 in that the control line 80 is attached to a pilot valve 113 to which it feeds the compressed air as operating pressure, which counters a spring 114 of this valve. Pilot valve 113 is a 2-way-2-position valve. Another pilot valve 116 is attached to control line 78 and supplies to this line the compressed air required for operation, of which the pressure counters a spring 118 of this pilot valve.

An input 120 of pilot valve 113 is attached to load line 4 through a control line 36 between pump 2 and pilot valves 6 and 14. Pressure maintenance valve 56, set at the pressure level $P_{KV2}$, lies in a connection line 122, and connects output 124 of pilot valve 113 with input 128 of the other pilot valve 116.

Pressure maintenance valve 48, which is set at peak level $P_{KV1}$, is found in a line 130, and connects output 124 of pilot valve 113 with another input 132 of another pilot valve 116.

Figure 6:
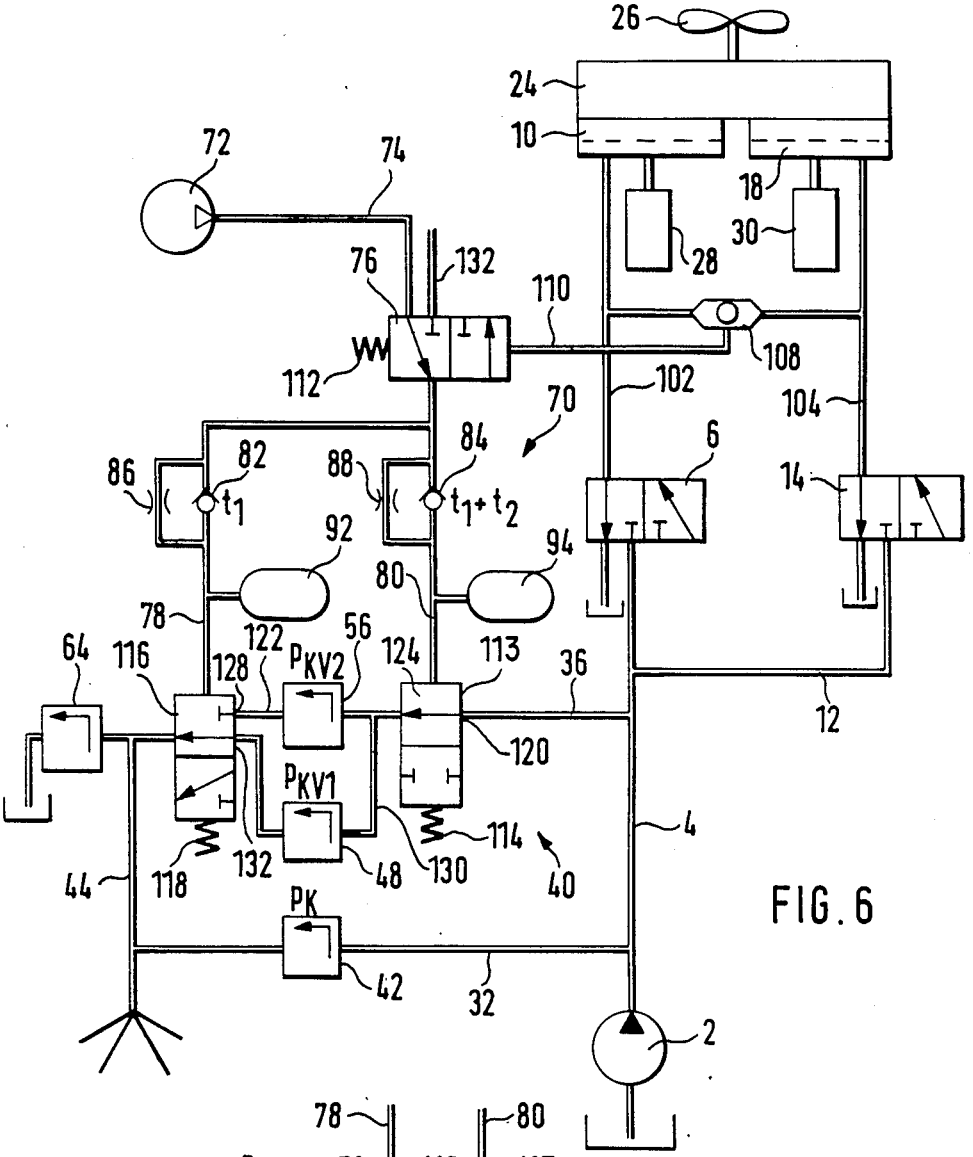
FIG. 6 is a schematic diagram of another embodiment of a control circuit of the invention for friction clutches in the drive line between the engine and a propeller of a ship power transmission system, with the clutches open.
Figure 10:
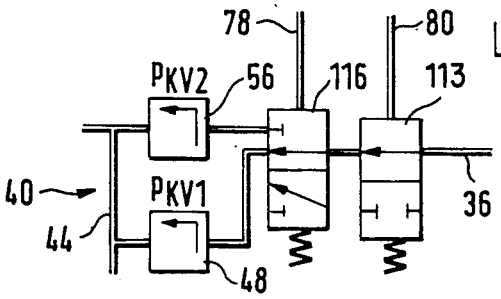
FIGS. 10 to 13, schematic diagrams of a third embodiment of the control circuit according to the invention, wherein each shows only the part of the circuit which is a modification of the embodiment shown in FIGS. 6 to 9, while the parts not shown are identical to those in said drawings.

FIG. 6 shows friction clutches 10 and 18 disengaged, i.e. open. The compressed air from compressed air source 72 passes through pilot valve 76 on pilot valves 113 and 116 and holds these two pilot valves 113 and 116 against the force of springs 114 and 118 in the position shown in FIG. 6. At this time, pressure maintenance valve 56 has no connection to common main 44. Pressure maintenance valve 48, however, has a pressure medium connection to common main 44 through pilot valve 116. Thus, through open pilot valve 113, pressure maintenance valve 48 holds the pressure in lead line 4 at peak level $P_{KV1}$. This peak pressure in load line 4, however, is not conveyed to friction clutches 10 and/or 18 because both pilot valves 6 and 14 are closed.

Figure 7:
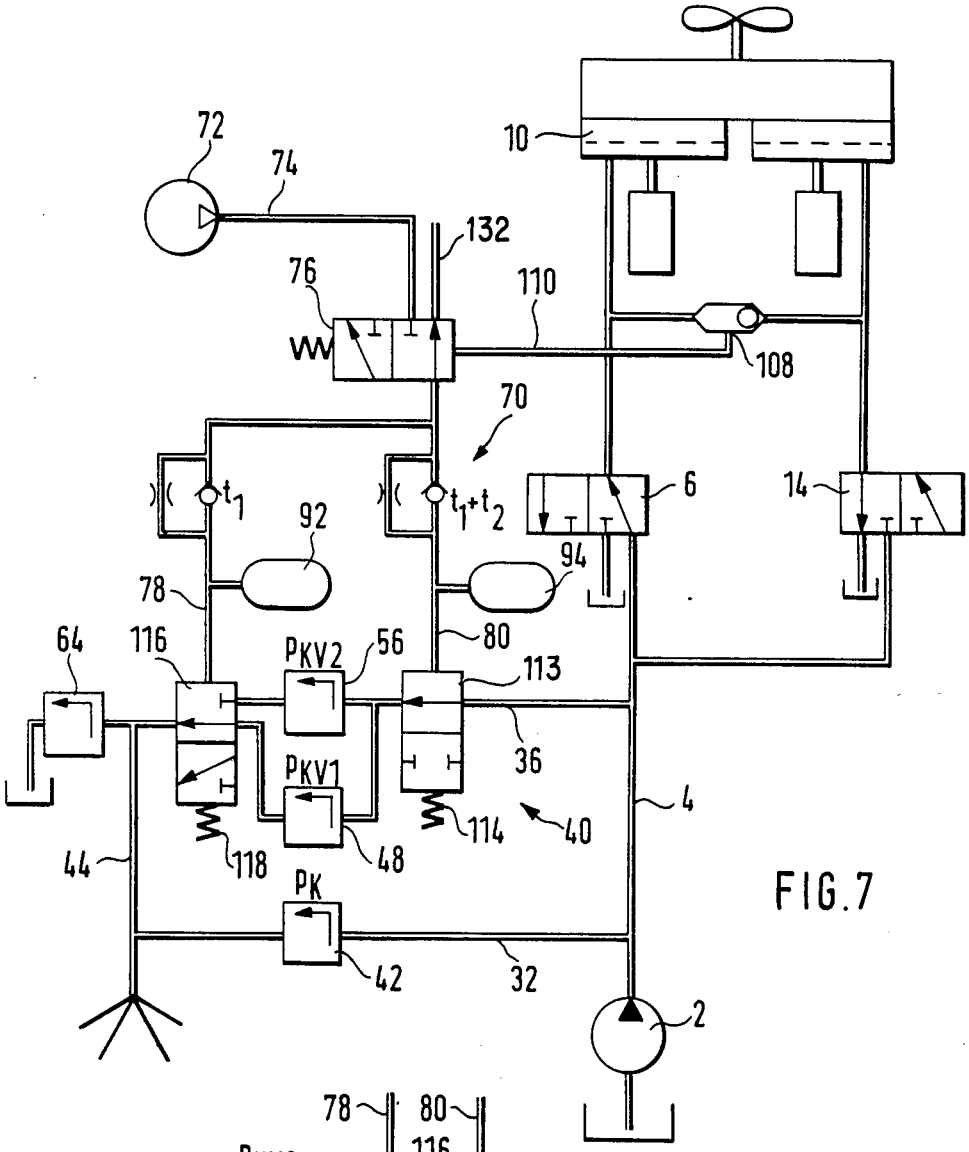
FIG. 7 is a schematic diagram of the control circuit of FIG. 6, during a first time phase, during actuation of the friction clutches during which the operating pressure of the friction clutches is at a predetermined peak pressure level.
Figure 11:
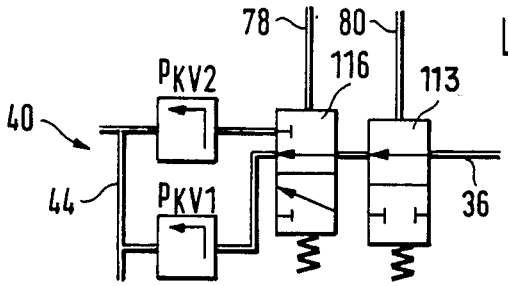
Figure 8:
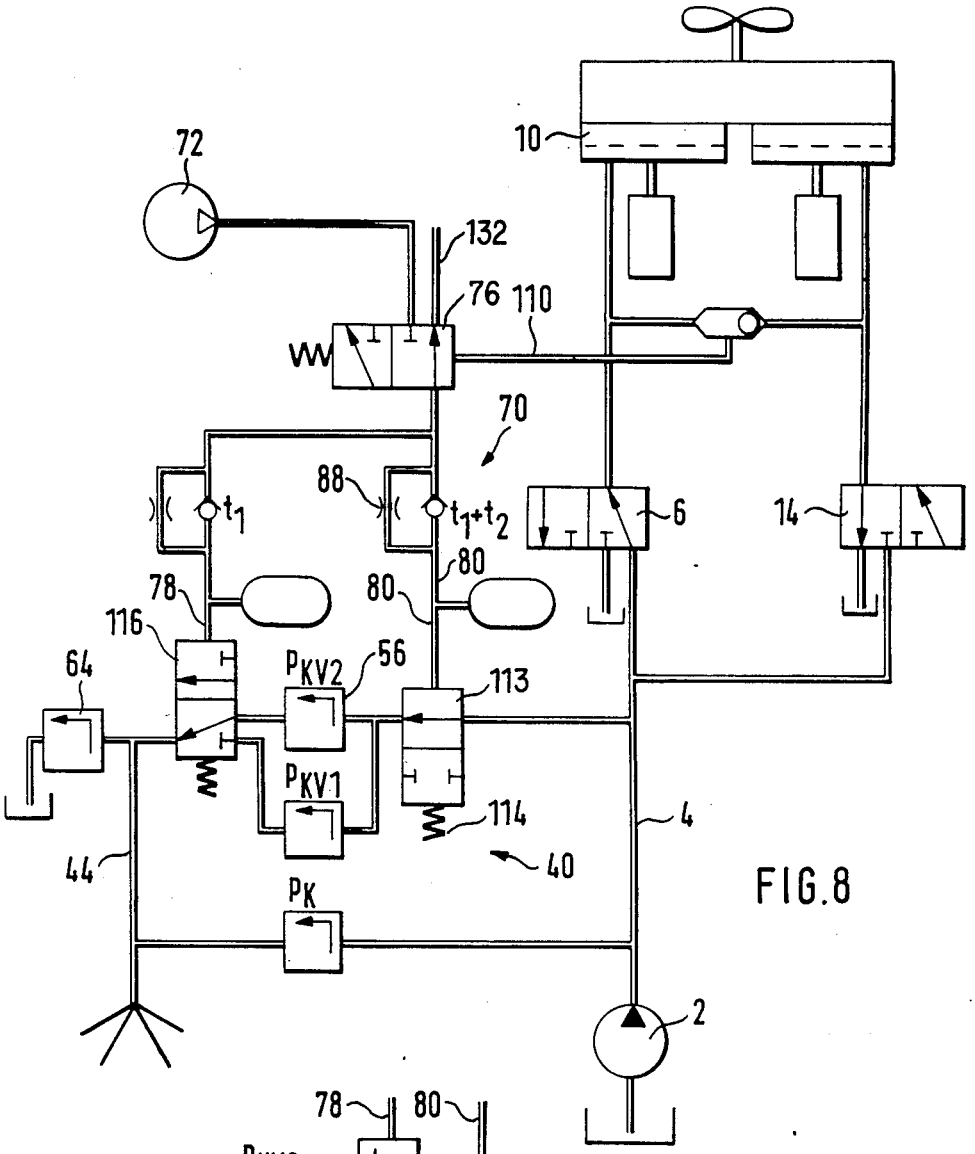
FIG. 8 is a schematic diagram of the control circuit of FIG. 6, during a second time phase, during which the operating pressure of the friction clutches is at an intermediate level lower than the peak level.
Figure 12:
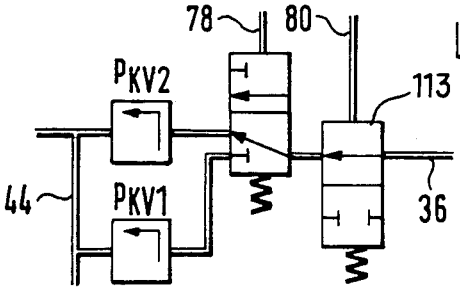

Henceforth, when pilot valves 6 and/or 14 are opened, for example valve 6 as shown in FIG. 7, the pressure in load line 4 drops from peak $P_{KV1}$ down to filling pressure $P_0$. This is shown in the diagram of FIG. 1. At the end of filling time $t_0$, the pressure in load line 4 again rises to peak $P_{KV1}$. This occurs because following the filling of friction clutch 10, the pressure oil from pump 2 again flows through pressure maintenance valve 48 to common main 44. With the rise of the pressure to peak $P_{KV1}$ in the cylindrical space of friction clutch 10, the pressure medium, present as oil, through double check valve 108 causes the switching of pilot valve 76 into a position in which this pilot valve 76 blocks the compressed air feed of line 74 and connects both control lines 78 and 80 with an outlet 132. Peak pressure $P_{KV1}$ is to be maintained in load line 4 so long as the pressure being produced in control line 78 can hold pilot valve 116 in position against the pressure of spring 118 as shown in FIGS. 6 and 7. During the time phase $t_1$, this is the case. At the end of time phase $t_1$, the pressure in control line 78 has dropped so far that spring 118 switches pilot valve 116 to the position shown in FIG. 8. Henceforth, the pressure medium of pump 2 must flow from load line 4 out through pressure maintenance valve 56 and both open pilot valves 113 and 116 to common main 44. The lower intermediate value $P_{KV2}$ is then established in load line 4, which through pilot valve 6 then also passes friction to clutch 10. This circuit state of FIG. 8 holds so long as the pressure of compressed air in control line 80 can hold pilot valve 113 against the pressure of spring 114 in the position shown in FIG. 8. Then, when the control pressure from control line 80 on pilot valve 113 has dropped through the flow throttle 88 by the end of time phase $t_2$ so that pilot valve 113 is switch by its spring 114 into closed position, the circuit state shown in FIG. 9 is obtained.

Figure 9:
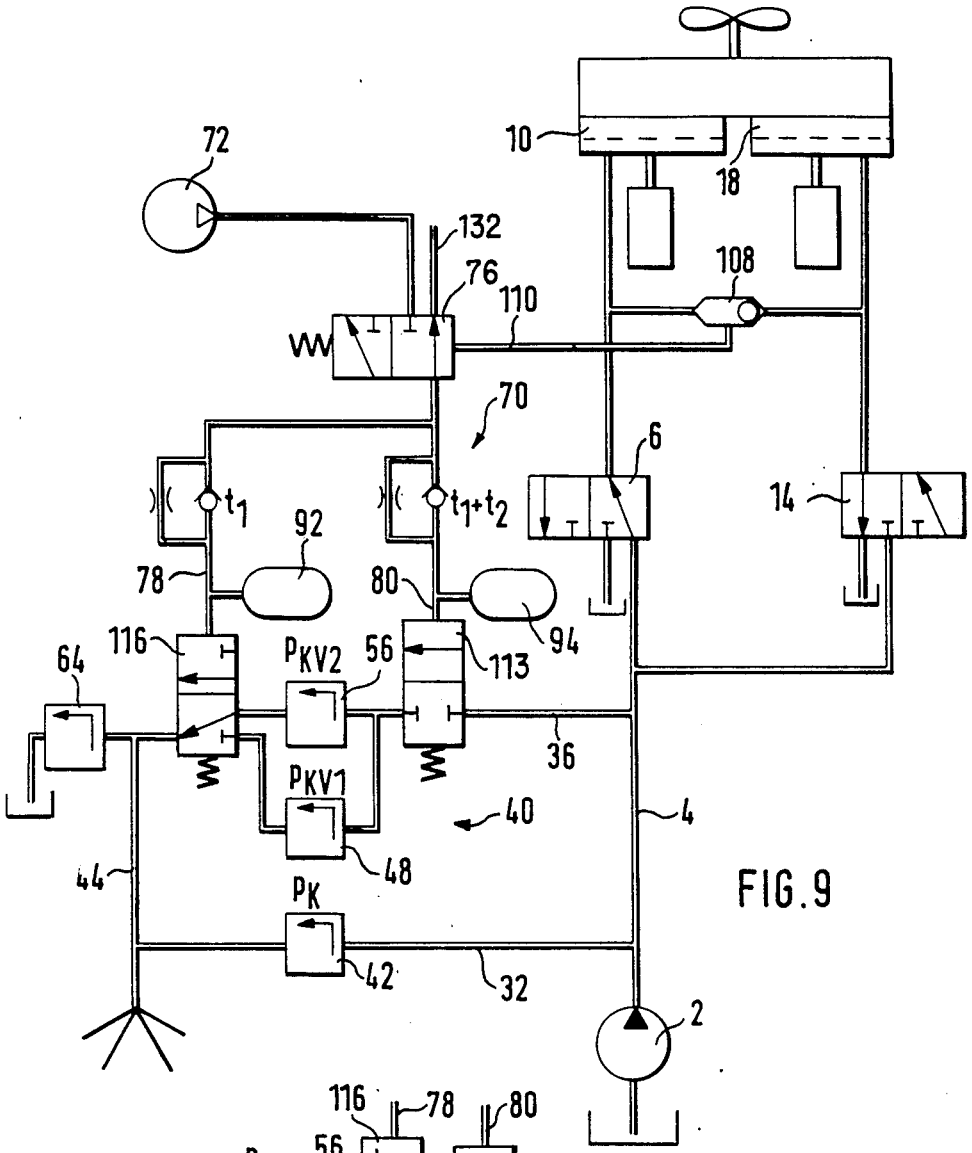
FIG. 9 is a schematic diagram of the control circuit of FIG. 6, during a third time phase, during which the operating pressure of the friction clutches is held at a final level.
Figure 13:
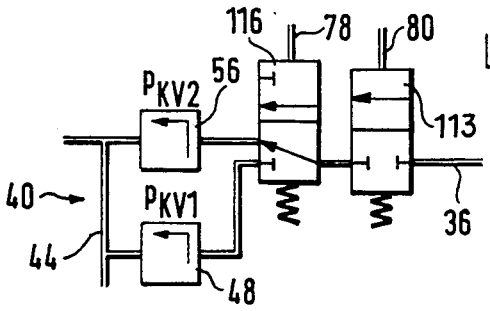

Pilot valve 113 is closed in the circuit state of FIG. 9, so that the pressure medium from pump 2 can flow out only through pressure maintenance valve 42 to common main 44. Thus, the final pressure $P_K$ is established in load line 4 and the cylindrical space of friction clutch 10. This then remains during the remaining switching time $t_3$ of friction clutch 10.

In the embodiment of FIGS. 6 to 9, both pressure maintenance valves 48 and 56 are connected for flow between both circuit valves 113 and 116. The same operation is then obtained when circuit pilot valve 116 is connected in the flow passage between pilot valve 113 and both pressure maintenance valves 48 and 56, as in FIGS. 10, 11 12 and 13. The circuit state setting of FIG. 10 corresponds operationally to that of FIG. 6; the circuit state setting of FIG. 11 corresponds operationally to that of FIG. 7; the circuit state setting of FIG. 12 corresponds operationally to that of FIG. 8; and the circuit state setting of FIG. 13 corresponds operationally to that of FIG. 9.

We claim:

1. A ship propulsion transmission system comprising:

at least one engageable friction clutch in a drive line between a ship engine and a ship propeller, comprising:

means for delivering a pressurized fluid from a pressure source through a pressure medium line to the friction clutch to actuate it, setting means for setting the operating pressure of said delivered pressurized fluid during the starting up of the power transmission, and said setting means including means for setting the fluid pressure at a plurality of different operating stages, in sequence, at least the first two of which stages are maintained for a predetermined time, wherein during the first stage pressure is maintained at a peak level, during the second stage pressure is maintained at an intermediate level and during the final stage pressure is maintained at a final level which is higher than that during any said intermediate stage.

2. A ship propulsion system according to claim 1, wherein the said final level is higher than all of the preceding said peak levels.

3. A ship propulsion system according to claim 1, including a pilot valve operatively connected to said pressure medium line and a pressure maintenance valve arrangement in a branch of the pressure medium line between the pressure source and the pilot valve and wherein the pressure maintainence valve arrangement is automatically shifted sequentially to different states to cause the different operating stages.

4. A ship propulsion system according to claim 1, wherein the pressure maintenance valve arrangement includes a plurality of pressure maintenance valves corresponding to a plurality of different operating stages, of which each pressure maintenance valve is set at one of said pressure levels, and wherein at any time only the pressure maintenance valve supplying the desired pressure level is open to the pressure medium line, while the other pressure maintenance valves are separated from the pressure medium line.

5. A ship propulsion transmission according to claim 9, wherein a flow medium-time circuit for operating the different pressure maintenance valves is attached to the pressure maintenance valve arrangement so as to connect the pressure maintenance valves sequentially for the different operating stages, said circuit including a flow throttle restrictor and at least two air storages which are emptied through the throttle restrictor such that the pressure drop times of each air storage determines for each respective pressure maintenance valve the end time point of the maintenance of the relevant pressure level of its respective operating stage, and hence the length of said predetermined time.

* * * * *